US006857185B2

(12) United States Patent
Barber et al.

(10) Patent No.: US 6,857,185 B2
(45) Date of Patent: Feb. 22, 2005

(54) METHOD FOR ELECTROMAGNETICALLY JOINING TUBES TO SHEETS IN A TUBULAR HEAT TRANSFER SYSTEM

(75) Inventors: John P. Barber, Dayton, OH (US); Robert M. Columbus, Centerville, OH (US); Bruce D. Kouse, Springfield, OH (US); Duane C. Newman, London, OH (US)

(73) Assignees: IAP Research, Inc., Dayton, OH (US); Elliott Tool Technologies Ltd., Dayton, OH (US)

( * ) Notice: Subject to any disclaimer, the term of this patent is extended or adjusted under 35 U.S.C. 154(b) by 0 days.

(21) Appl. No.: 10/154,700

(22) Filed: May 24, 2002

(65) Prior Publication Data

US 2003/0218333 A1 Nov. 27, 2003

(51) Int. Cl.[7] ..... B21D 39/08; B23P 17/00

(52) U.S. Cl. ..... 29/890.044; 29/419.2; 29/523; 29/727; 72/370.07; 72/56

(58) Field of Search ..... 29/890.044, 419.2, 29/727, 523; 72/370.07, 56

(56) References Cited

U.S. PATENT DOCUMENTS

| | | | | |
|---|---|---|---|---|
| 3,599,461 A | * | 8/1971 | Astl | 72/56 |
| 3,618,350 A | * | 11/1971 | Larrimer, Jr. et al. | 72/56 |
| 3,636,607 A | | 1/1972 | DeMarco | |
| 3,998,081 A | | 12/1976 | Hansen et al. | |
| 4,059,882 A | | 11/1977 | Wunder | |
| 4,159,564 A | | 7/1979 | Cooper, Jr. | |
| 4,216,826 A | | 8/1980 | Fujikake | |
| 4,473,862 A | | 9/1984 | Hill | |
| 4,531,393 A | | 7/1985 | Weir | |
| 4,619,127 A | | 10/1986 | Sano et al. | |
| 4,889,679 A | | 12/1989 | Snyder et al. | |
| 4,924,584 A | | 5/1990 | Harney | |
| 4,929,415 A | | 5/1990 | Okazaki | |
| 4,947,667 A | | 8/1990 | Gunkel et al. | |
| 4,975,412 A | | 12/1990 | Okazaki et al. | |
| 5,050,669 A | | 9/1991 | Nenstiel et al. | |
| 5,154,679 A | | 10/1992 | Fuller et al. | |
| 5,405,574 A | | 4/1995 | Chelluri et al. | |
| 5,457,977 A | | 10/1995 | Wilson | |
| 5,611,139 A | | 3/1997 | Chelluri et al. | |
| 5,611,230 A | | 3/1997 | Chelluri et al. | |
| 5,687,599 A | * | 11/1997 | Donaldson et al. | 72/56 |
| 5,689,797 A | | 11/1997 | Chelluri et al. | |
| 5,761,810 A | * | 6/1998 | Insalaco et al. | 29/890.044 |
| 5,826,320 A | * | 10/1998 | Rathke et al. | 29/419.2 |
| 5,853,507 A | | 12/1998 | Ali et al. | |
| 5,887,476 A | | 3/1999 | Damsohn et al. | |
| 5,983,478 A | | 11/1999 | Dolan et al. | |
| 6,050,121 A | | 4/2000 | Daehn et al. | |
| 6,178,636 B1 | | 1/2001 | Kroger et al. | |
| 6,273,963 B1 | | 8/2001 | Barber | |

* cited by examiner

*Primary Examiner*—David P. Bryant
(74) *Attorney, Agent, or Firm*—Jacox Meckstroth & Jenkins

(57) ABSTRACT

A system and method for expanding, joining or securing a plurality of tubes by electromagnetic expansion to a plurality of sheets in a tubular heat transfer system. The system and method involve the automatic sensing and positioning of a electromagnetic coil in operative relationship with at least a portion of a tube and an inner wall of a sheet and then energizing the electromagnetic coil to expand the portion of the tube to engage the inner wall of the sheet, thereby securing the tube thereto. A tubular heat transfer system tube expander and method are also shown.

6 Claims, 8 Drawing Sheets

Lhe
Hhe
10
12
12a
12b
12c
12d
12e
13
14
14a
14b
16
16a
16b
18
20
22
24
26
28
32
34
36a
36b
36c
36d
44
46
50
52
54
56
58
66

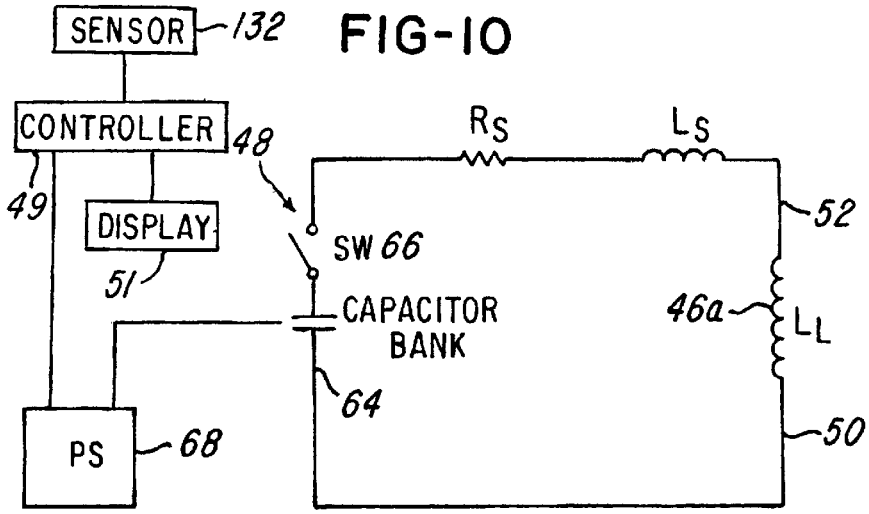
FIG-10
FIG-11
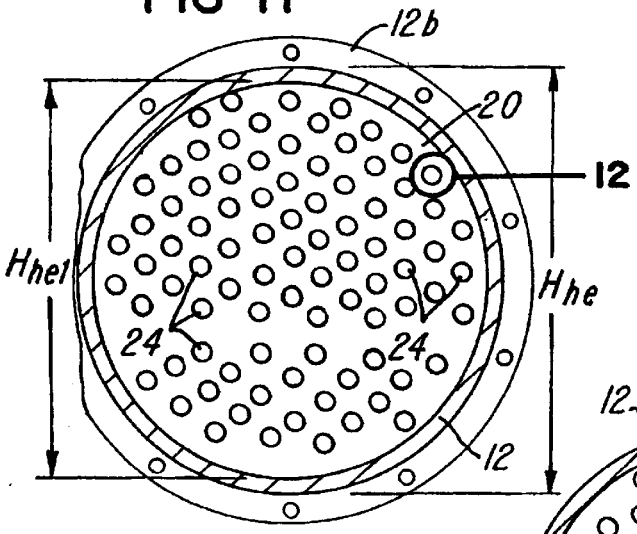
FIG-12
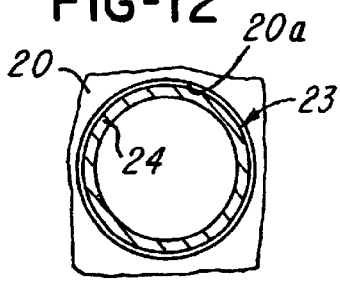
FIG-13
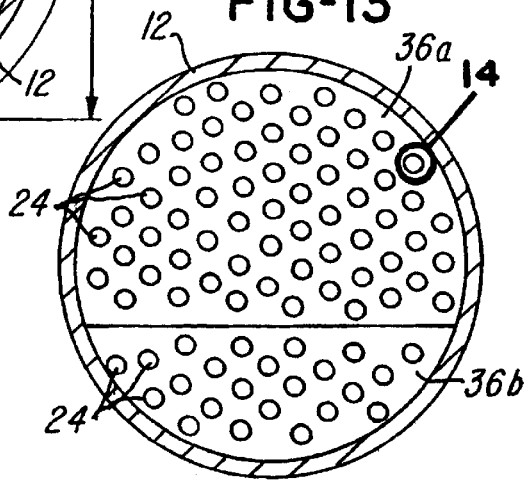
FIG-14
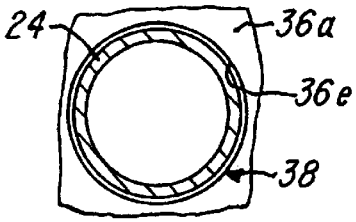

METHOD FOR ELECTROMAGNETICALLY JOINING TUBES TO SHEETS IN A TUBULAR HEAT TRANSFER SYSTEM

BACKGROUND OF THE INVENTION

1. Field of the Invention

The invention relates to a process for joining a tube, such as either a finned/enhanced tube or a prime/smooth surface tube, to at least one baffle, support, and/or tube sheet in the manufacture or maintenance of a tubular heat transfer system that uses an electromagnetic force to expand the tubes such that the outer surface of the tubes makes joining contact with apertures in the sheets.

2. Description of the Related Art

Tubular heat transfer systems include tubular systems of the type conventionally employed in air conditioners, heat exchangers, chillers, evaporators, boilers, and absorption units. The efficiency of tubular heat transfer systems is dependent in substantial measure on the efficiency of heat transferred between a media circulated through tubes and another media in heat exchange relation to the exterior of the tubes. The efficiency of heat transferred between the fluid surrounding the tubes is also enhanced by avoiding laminar flow of the fluid over the tubes.

The tubes used in a tubular heat transfer system are held in place by tube sheets situated on the end of the tubular heat transfer system. One or more tube supports sheets or baffle sheets may be provided to support the tubes between the tube sheets. Tubular heat transfer system tubes are supplied in various surface configurations that enable certain media to exchange heat better than others. The expander referenced here will expand either prime/smooth tubes or enhanced/finned tubes. Enhanced tubes are manufactured with a variety of inside surface raised ridges to provide turbulence to the flow through the tube, which enables greater heat transfer. Finned tubes are also manufactured with a variety of fin configurations on the outside surface and are selected based on the media that is being used to transfer heat over the tubes. Because of these two surface configurations, current tube expanders are unable to adequately expand these enhanced/finned tubes. Conventionally inside surface enhancing and outside surface finning are suspended in areas where the tube is to be joined to the support/baffle sheets and the end tube sheets because conventional tube expanders destroy internal ridges and overwork the tube and produce stress cracking at the junctions between the tube and the support/baffle sheets. In general, the ability to expand a tube is dependent on three conditions, the tube's thickness, diameter and the material the tube is made from.

U.S. Pat. No. 5,050,669 discloses a tube support which includes at least two parallel plates. The plates comprise a plurality of pins that approximate the leading and trailing edges of the plates in order to maintain the plates in a spaced relationship. The pins and plates provide support for the tubes. The use of electromagnetic force to expand a tube is described in U.S. Pat. No. 5,853,507 to Alie et al.; U.S. Pat. No. 6,050,121 to Daehn et al.; U.S. Pat. No. 4,947,667 to Gunkel et al.; U.S. Pat. No. 5,457,977 to Wilson; U.S. Pat. No. 4,924,584 to Hamey; U.S. Pat. No. 4,059,882 to Wunder; U.S. Pat. No. 6,273,963 to Barber U.S. Pat. No. 4.929,415 to Okaziki; U.S. Pat. No. 4,975,412 to Okaziki; U.S. Pat. No. 5,405,574 to Chelluri at al.;

If the intersection or joint between the tubes and tube sheets or baffle sheets is not tight, fluid can leak from the heat exchanger shell over time. Also, if the intersection or joint between the tube and baffle or support sheets is not tight, fluid flow will cause vibration between the tube and baffle or support sheet that can lead to undesirable wearing of the tube at the interface. Over time this wearing can lead to premature failure of the tube.

There is, therefore, a need for a tubular heat transfer system manufacturing system and method for securing a plurality of tubes to any surrounding members, such as support plates, end plates or baffle plates which improves the securing of the tubes to the sheets and which can be used to join enhanced or finned tubes without damaging the tube.

SUMMARY OF THE INVENTION

In one aspect this invention comprises a method for securing a conductive tube to at least one surrounding member of a tubular heat transfer system, the method comprising the steps of inserting a coil into the conductive tube until the coil is positioned in operative relationship with the conductive tube and the surrounding member and energizing the coil to expand at least a portion of the conductive tube to engage the at least one surrounding member, thereby securing the conductive tube to the at least one surrounding member.

Another aspect of the invention is a method for securing a plurality of conductive tubes to a plurality of plates to provide a tube bundle in a tubular heat transfer system, each of the plurality of plates having a plurality of inner walls defining a plurality of apertures, respectively, the method comprising the steps of situating the plurality of conductive tubes in the plurality of apertures, respectively, and magnetically increasing a diameter of at least a portion of at least one of the plurality of conductive tubes into engagement with at least one of the plurality of inner walls, thereby securing the at least one of the plurality of conductive tubes to the at least one of the plurality of inner walls.

Yet another aspect of this invention comprises a method for enlarging a first portion and a second portion of a conductive tube for use in a tubular heat transfer system, the system comprising the steps of: moving a coil to a first position in operative relationship with the first portion of the conductive tube, energizing the coil to enlarge the first portion of the conductive tube at the first position, moving the coil to the second position in operative relationship with the second portion of the conductive tube, and energizing the coil to enlarge the second portion of the conductive tube at the second position.

Still another aspect of this invention comprises a method for assembling a tubular heat transfer system having a housing, the method comprising the steps of providing a plurality of sheets, each of the plurality of sheets comprising a plurality of inner walls defining a plurality of apertures, respectively, positioning a plurality of conductive tubes into the plurality of apertures, respectively, inserting a coil into a first conductive tube of the plurality of conductive tubes, moving the coil to a first position in the first conductive tube, the first position corresponding to where a first inner wall of the plurality of inner walls, and the coil become substantially aligned, energizing the coil to enlarge the first portion of the first conductive tube adjacent the first inner wall to secure the first portion of the first conductive tube to the first inner wall, moving a second coil to a next position in the first conductive tube, the second position corresponding to where the second inner wall of a second sheet and the coil become substantially aligned, energizing the coil to enlarge the second portion of the first conductive tube adjacent the second inner wall to secure the second portion of the first conductive tube to the second inner wall, and repeating the steps until each of the plurality of conductive tubes is secured to the plurality of sheets.

Still another aspect of this invention comprises a tube bundle in a tubular heat transfer system, comprising a plurality of walls defining a plurality of apertures, respectively, a conductive tube situated in each of the plurality of apertures, and the conductive tube comprising an enlarged portion at each of a plurality of positions at which at least one of the plurality of walls surrounds the tube, thereby causing an interference fit between the enlarged portion and the at least one of the plurality of walls engaged by the enlarged portion, wherein the conductive tube comprises a continuously enhanced tube.

Yet another aspect of this invention comprises a tubular heat transfer system comprising, a plurality of sheets comprising a plurality of walls defining a plurality of apertures, respectively, a plurality of conductive tubes situated in the plurality of apertures, respectively, each of the plurality of walls surrounding each of the plurality of conductive tubes at a plurality of positions, each of the plurality of conductive tubes comprising an enlarged portion at each of the plurality of positions to cause an interference pressure between the enlarged portion and at least one of the plurality of walls engaged by the enlarged portion, thereby securing the plurality of conductive tubes to the plurality of walls to provide a tube bundle, a housing for surrounding the tube bundle, each of the plurality of conductive tubes comprising a continuously enhanced tube, and the plurality of sheets comprising a first tube sheet and a second tube sheet for sealing the housing to define an inlet area, a heat exchange area, and an outlet area, the housing having an inlet opening associated with the inlet area and an outlet opening associated with the outlet area, the plurality of conductive tubes enabling communication of fluid between the inlet area and the outlet area.

Still another aspect of this invention comprises a heat exchange tube expander for use relative to a tubular heat transfer system comprising a plurality of conductive tubes, the heat exchange tube expander comprising a coil for inserting into at least one of the plurality of conductive tubes and positioning at a plurality of positions in the at least one of the plurality of conductive tubes, a circuit coupled to the coil, the circuit comprising a capacitor discharge bank having a predetermined capacitance and being capable of receiving a predetermined charge voltage, and a switch for discharging the capacitor discharge bank to energize the coil to increase a diameter of at least a portion of the at least one of the plurality of conductive tubes to force an outer surface of the at least a portion into engagement with a surrounding member.

Yet another aspect of this invention comprises a method for securing a conductive tube to a surrounding member of a tubular heat transfer system, the method comprising the steps of inserting a coil into a conductive tube, moving the coil along the inside of the tube, when the coil reaches a position at which the tube intersects the surrounding member, while the coil is moving, energizing the solenoid to expand the portion of the conductive tube at the position of intersection and thereby securing the conductive tube to the surrounding member.

Still another aspect of this invention comprises a tube bundle for use in a tubular heat transfer system, comprising a plurality of sheets comprising a plurality of walls defining a plurality of apertures, respectively, a conductive tube situated in each of the plurality of apertures, and the conductive tube comprising a magnetically enlarged portion at each of a plurality of positions at which at least one of the plurality of walls surrounds the tube, thereby causing an interference fit between the magnetically enlarged portion and the at least one of the plurality of walls engaged by the magnetically enlarged portion.

Still another aspect of this invention comprises an expander assembly comprising an expander for magnetically enhancing at least a portion of a tube into a surrounding member as the expander is moved through the tube, and a sensor connected with the expander for sensing a position of the surrounding member.

The invention will be described in more detail by reference to specific embodiments thereof, the following description, and the accompanying drawings.

BRIEF DESCRIPTION OF ACCOMPANYING DRAWING

FIG. 10 is a circuit in accordance with one embodiment of the invention;

FIG. 11 is a sectional view taken along the line 11—11 in FIG. 2;

FIG. 12 is an enlarged fragmentary sectional view illustrating a relationship between a tube and an inner wall of the tube sheet shown in FIG. 11;

FIG. 13 is a sectional view taken along the line 12—12 in FIG. 1;

FIG. 14 is an enlarged fragmentary sectional view illustrating a relationship between a tube and an inner wall of a baffle sheet shown in FIG. 13;

FIG. 17B is a sectional view taken along the line 17B—17B in FIG. 17A;

DETAILED DESCRIPTION OF PREFERRED EMBODIMENT

Figures 1, 2, 3:
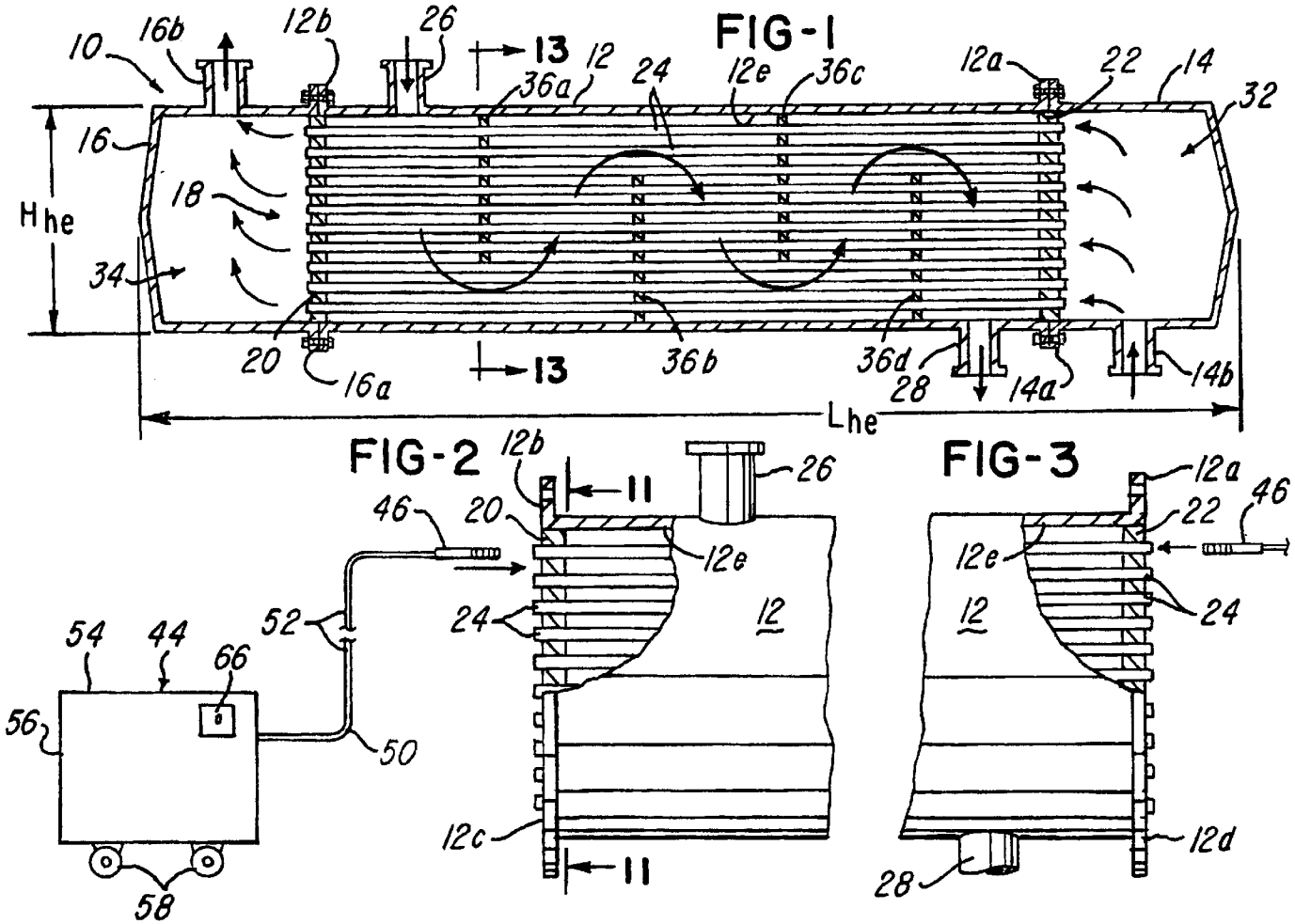
FIG. 1 is a sectional view of a tubular heat transfer system in accordance with one embodiment of the invention.
FIG. 2 is a fragmentary sectional view of one end of the tubular heat transfer system shown in FIG. 1 before an end bell is secured thereto.
FIG. 3 is fragmentary sectional view showing a second end of the tubular heat transfer system shown in FIG. 1.

Referring now to FIG. 1, a heat exchanger is shown. For ease of illustration, the invention will be described relative to a heat exchanger 10, but it is to be understood that the invention may be used with any type of tubular heat transfer system, such as a heat exchanger, a chiller, an air conditioner or an absorption unit. The heat exchanger 10 comprises a shell or housing 12 having a first flange 12*a*, a second flange 12*b*, a first end 12*c*, a second end 12*d* and an inner surface 12*e*. A first header or end cap 14 having a flange 14*a* is secured to the flange 12*a* and a second header or end cap 16 having a flange 16*a* is secured to flange 12*b* by nuts and bolts, as shown in FIG. 1.

The heat exchanger 10 comprises a tube bundle 18 situated in the housing 12. The tubes may be prime/smooth tubes or enhanced and/or finned tubes. The term "enhanced" is used herein to refer to tubes having an inside surface that is enhanced by providing a fine network of relatively closely spaced ridges that are arranged to enhance heat transfer between the tube and the heat exchange fluid (typically water) that flows through the tube. The term "finned" refers to an enhanced surface on the outside of the tube in the form of relatively finely spaced fins. Examples of enhanced tubes are provided in U.S. Pat. No. 4,216,826 to Furukawa Metals Co., Ltd. and U.S. Pat. No. 4,660,630 to Wolverine Tube, Inc., which are incorporated herein by reference and made a part hereof. The tube may comprise any electrically conductive material, such as copper or other suitable electrically conductive material.

The term "continuous enhanced" as used herein refers to a tube which is enhanced and/or finned and the enhanced and/or finned area is not periodically interrupted by a flat or smooth area. Conventionally, the enhanced surfaces on an enhanced tube are interrupted by smooth areas at the points of intersection with the support and baffle sheets because conventional expanders can overwork and crack the enhanced tube in the expanded areas. In accordance with certain embodiments of the invention, enhanced tube that is not interrupted by these smooth areas can be used. This has several advantages. First, the enhanced tube is less expensive to manufacture because it can be manufactured as continuous enhanced tube without altering or interrupting the manufacturing process to provide a smooth area. Second, the heat transfer efficiency of the tube is better because a greater surface area of tube is enhanced and/or finned. The combined effect of these two advantages should yield significant economies.

Particularly when using enhanced/finned tube, but potentially also with prime/smooth tube, it may be desirable to use a sealing media such as a conventional tube or plumbing solder or chemical sealant to seal any spaces between the tube outer surface and the surrounding sheets. In particular, the solder or chemical sealant will fill the spaces between the ridges and fins of an enhanced tube as well as the spaces between these ridges and fins and the surrounding sheets.

Figure 4:
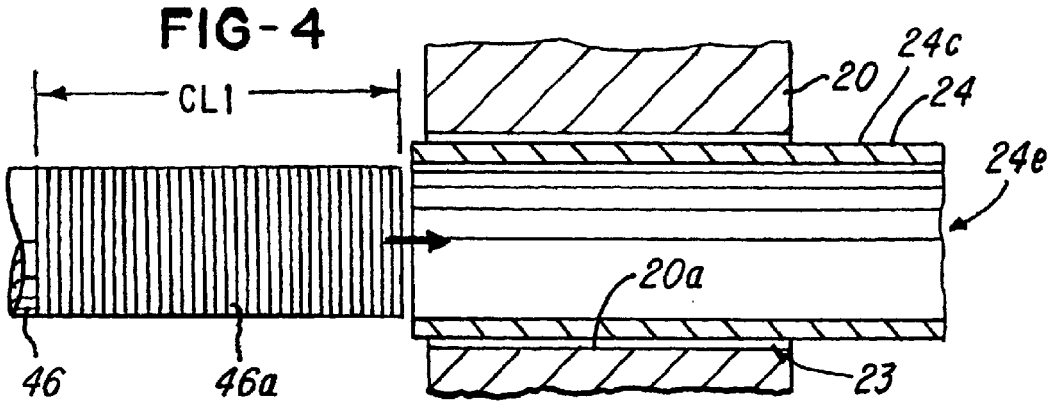
FIG. 4 is a fragmentary sectional view illustrating a relationship among a tube, tube sheet and coil before a portion of the tube is expanded.

The tube bundle 18 comprises a first surrounding member or tube sheet 20 and a second surrounding member or tube sheet 22. In the embodiment being described, the tube sheets 20 and 22 are substantially the same and support a plurality of conductive tubes 24, as illustrated in FIG. 1. For ease of description, the invention will be described relative to tube sheet 20, but it should be understood that tube sheet 22 comprises substantially the same configuration. The tube sheet 20 comprises a plurality of inner walls, such as inner walls 20*a* (FIG. 12) that define a plurality of apertures 23 for receiving the plurality of conductive tubes 24, respectively, as illustrated in FIGS. 4 and 11.

The plurality of conductive tubes 24 are secured to the tube sheets 20 and 22 in accordance with the system and method described later herein. After one of the plurality of conductive tubes 24 is situated in one of the apertures 23, the system and method according to the invention may be applied to a portion, such as portion 24*a* in FIG. 6, of the conductive tube 24 to expand a diameter of the tube 24 from a first diameter $D_1$ (FIG. 6) to a second diameter $D_2$, thereby securing the tube 24 to the inner wall 20*a* of tube sheet 20. Note that after the plurality of conductive tubes 24 are secured to the tube sheets 20 and 22, they become aligned in a generally parallel relationship, as illustrated in FIG. 1.

To facilitate supporting the plurality of conductive tubes 24 and providing heat exchange, the tube bundle 18 also comprises a plurality of support sheets or baffle sheets 36*a*–36*d*. The plurality of baffle sheets 36*a*–36*d* support the tubes 24 between the tube sheets 20 and 22 and provide a baffle to interrupt the flow of fluid between a first inlet opening 26 and a first outlet opening 28 in the housing 12. As illustrated in FIGS. 13 and 14, each of the plurality of baffle sheets 36*a*–36*d* comprises a plurality of inner walls, such as inner walls 36*e* in sheet 36*a*, defining a plurality of apertures 38, respectively, for receiving the plurality of conductive tubes 24 as shown. The invention will be described relative to sheet 36*a*, but it should be understood that the sheets 36*b*–36*d* function and are configured in the same or similar manner.

As described later herein, the sheets 20, 22 and 36*a*–36*d* may be assembled with the tubes 24 to provide the tube bundle 18, which is then situated in housing 12. Alternatively, the sheets 20, 22 and 36*a*–36*d* may be welded, for example, to housing 12 and then the tubes 24 inserted in the apertures 23 and 38. Note that a heat exchange area 30 is defined by the housing 12 and sheets 20 and 22. Note also that an inlet area 32 and an outlet area 34 are provided when the end bells 14 and 16, respectively, are situated or mounted to the housing 12, as illustrated in FIG. 1. It should be understood that the tube sheets 20 and tubes 24 are sealed so that the heat exchange area 30 is not in fluid or gas communication with either the inlet area 32 or outlet area 34. Also, note that the plurality of conductive tubes 24 is in fluid communication with the inlet area 32 and outlet area 34. This permits fluid to flow into the inlet area 32 via a second inlet 14*b*, through the plurality of conductive tubes 24, into outlet area 34, and exit through a second outlet area 16*b*, as illustrated in FIG. 1. Substantially simultaneously with such fluid flow through the plurality of conductive tubes 24, a second fluid or gas is caused to flow through the first inlet opening 26, around the tubes 24 in the heat exchange area 30, and exit through the first outlet opening 28. The fluid flowing through the plurality of conductive tubes 24 is of a first temperature and the fluid flowing into the heat exchange area 30 and around the plurality of conductive tubes 24 is of a second temperature, which is different from the first temperature, thereby providing the desired heat exchange. In the embodiment being described, there is a temperature difference between the second fluid and the temperature of the fluid flowing through the plurality of conductive tubes 24. Also, at least one of the fluids may be a coolant, such as air, water, ethylene glycol or any suitable cooling fluid.

As mentioned, the plurality of conductive tubes 24 are secured to the inner walls 20*a* of tube sheets 20 and 22. The plurality of conductive tubes 24 are also secured to the inner walls, such as wall 36*e* of baffle sheet 36*a*, of baffle sheets 36*a*–36*d* (FIGS. 9 and 14) to secure the plurality of conductive tubes 24 to the baffle sheets 36*a*–36*d*. As illustrated in FIG. 1, the plurality of baffle sheets 36*a*–36*d* have a staggered arrangement to facilitate interrupting a flow path of fluid between the first inlet opening 26 and the first outlet opening 28 to facilitate heat exchange. It should be understood that the pattern of the plurality of apertures 38 defined by the plurality of inner walls 36*e* of the baffle sheets 36*a*–36*d* corresponds to the pattern of apertures or openings in the tube sheets 20 and 22, such as apertures 20*a* in FIG. 4.

Figure 6:
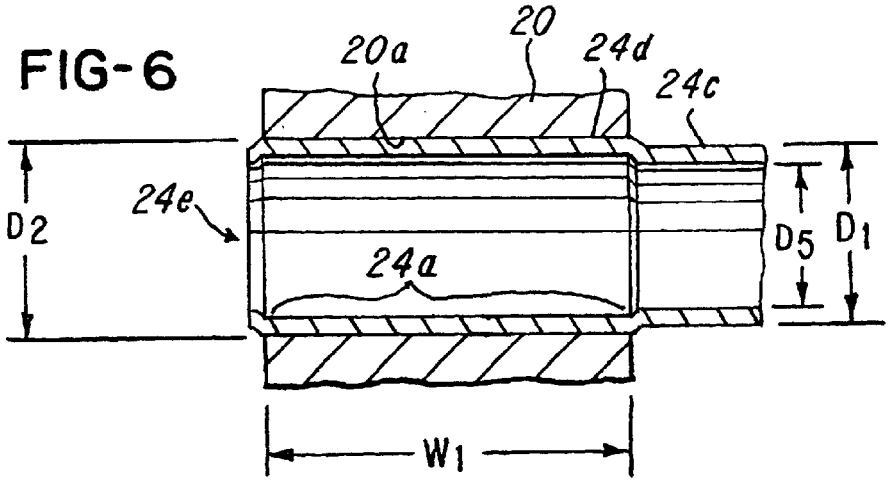
FIG. 6 is a fragmentary sectional view showing the portion of the tube expanded in accordance with one embodiment of the invention.
Figure 9:
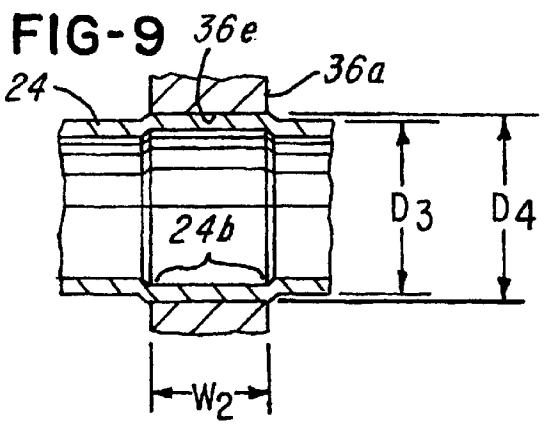
FIG. 9 is a fragmentary sectional view illustrating a portion of the tube expanded after the coil shown in FIG. 8 was energized.

As illustrated in FIGS. 6 and 9, each of the plurality of conductive tubes 24 is secured to the baffle sheets 36*a*–36*d* and tube sheets 20 and 22 by enlarging a portion, such as portion 24*a* (FIG. 6) and portion 24*b* (FIG. 9), of each plurality of conductive tubes 24 to provide an interference fit at the intersection or joint between the tube 24 and the walls 20*a* (FIG. 6) and 36*e* (FIG. 9). Note, for example, that the portion 24*a* (FIG. 6) is enlarged from the first diameter $D_1$ (FIG. 6) to the second diameter $D_2$ using the system and method of the invention. In this regard, it should be appreciated that each of the plurality of tubes 24 is enlarged only in the areas where the tube 24 is surrounded by the inner walls 20*a* and 36*e*, as illustrated in FIGS. 6 and 9, respectively. By enlarging only the portions 24*a* and 24*b* of tube 24 adjacent to the surrounding members, such as sheets 20, 22 and 36*a*–36*d*, the amount of time necessary to secure the plurality of conductive tubes 24 to the baffle sheets 36*a*–36*d* and tube sheets 20 and 22 is reduced. Advantageously, it should be appreciated that the entire process may be conducted from either end of the tube 24. Alternatively, the process may be performed so that approximately one-half of the tube 24, beginning at one end, is secured to surrounding members and then the coil 46*a* is removed and inserted into the other end of the tube 24 so that a second half of tube 24 may be processed from the other end.

In the embodiment being described, the baffle sheets 36*a*–36*d* (FIG. 1) and tube sheets 20 and 22 may each comprise different widths or thicknesses. For example, the tube sheets 20 and 22 may have a thickness or width $W_1$ (FIG. 6) that may vary, and the baffle sheets 36*a*–36*d* may each comprise a thickness or width $W_2$ (FIG. 9) that may vary in the embodiment being described. It should be appreciated that an outer diameter $D_3$ (FIG. 9) of the tube 24 is substantially the same as the diameter $D_1$ (FIG. 6) before the tube 24 is joined to the sheet 36*a*, which is the only baffle sheet joint shown in FIG. 9 for ease of illustration. After securing the tube 24 to the sheets 20 and 36*a*–36*d*, the tube 24 in FIG. 9 will have an enlarged diameter $D_4$ that is substantially the same as diameter $D_2$ in FIG. 6 of the diameters of the inner walls 36*e* and 20*a*, respectively, are the same. It should be appreciated, however, that these diameters $D_2$ and $D_4$ may be different and will vary depending on the diameter of the inner walls 20*a* and 36*a*, respectively. It has been found, however, that keeping the diameter of the inner walls 20*a* (FIG. 6) and 36*e* the same facilitates manufacturing, assembling and repairing the heat exchanger 10. The system and method for enlarging portion 24*a* and portion 24*b* of each of the plurality of conductive tubes 24 to secure the tubes 24 to the sheets 20, 22 and any surrounding sheets 36*a*–36*d* will now be described.

Figure 7:
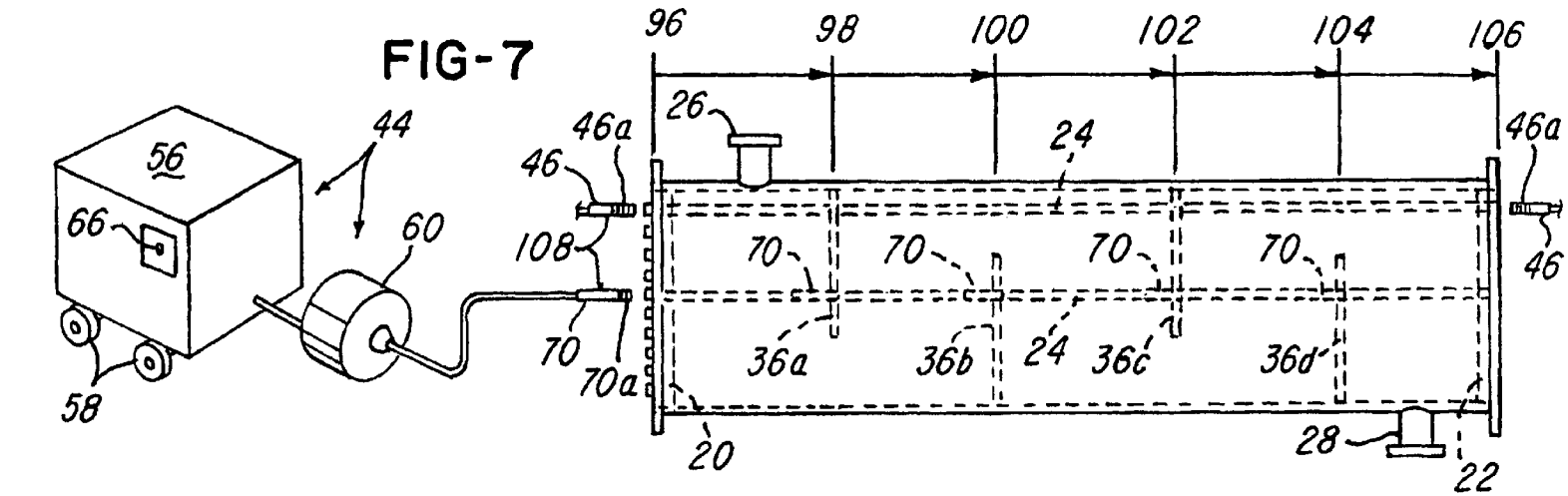
FIG. 7 illustrates a heat exchange tube expander and the various positions at which one or more portions of the tube can be expanded to secure it to any surrounding sheets.
Figure 8:
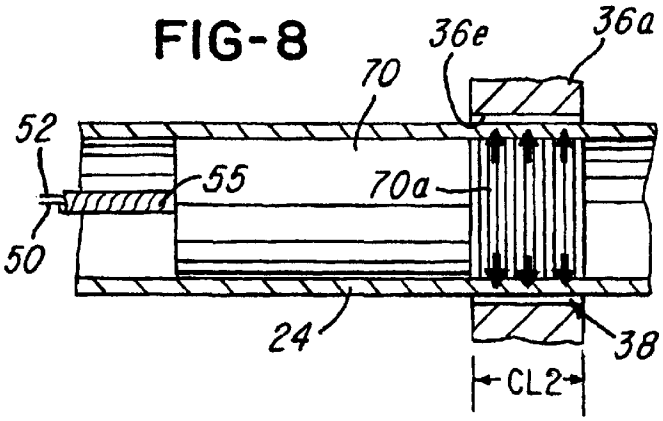
FIG. 8 is a fragmentary sectional showing another coil situated in operative relationship with the tube and a baffle sheet.

The system comprises a heat exchange tube expander 44 (FIGS. 1 and 7) for expanding the portion 24*a* (FIG. 6) and portion 24*b* (FIG. 9) as shown. The heat exchange tube expander 44 comprises a coil 46 which is conductively coupled to circuit 48 (FIG. 10) by an insulated cord 55 (FIG. 8) comprising a pair of conductors 50 and 52. The coil 46 may be a solenoid. Note that the circuit 48 is housed in a suitable housing 54 (FIGS. 2 and 7) that comprises a plurality of wheels 58, so that the heat exchange tube expander 44 is portable. As illustrated in FIG. 7, the heat exchange tube expander 44 may comprise a take-up mechanism 60, such as a reel or basket, for storing the insulated cord 54.

Figure 5:
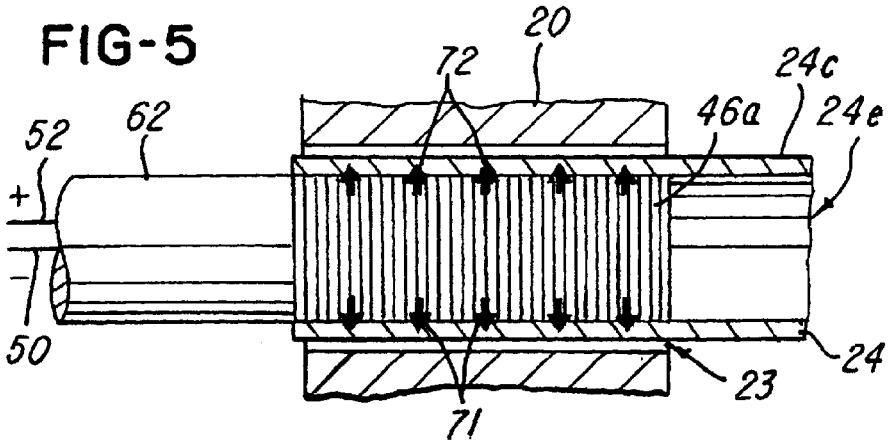
FIG. 5 is a fragmentary sectional view similar to FIG. 4 showing the coils situated in operative relationship to the tube and tube sheet.

In the embodiment being described, the solenoid or coil 46 comprises a coil 46*a* which, as mentioned above, is coupled to the conductors 50 and 52 (FIG. 10). To facilitate moving the coil 46*a* into position, the coil 46*a* may be turned around a nonconductive tubular mandrel 62 (FIG. 5). In the embodiment being described, the nonconductive mandrel 62 is tubular and is made of glass fiber reinforced epoxy and may be sized to the tube inside diameter, depending on the inner diameter $D_5$ (FIG. 6) of the tube 24. In one embodiment, the coil 46*a* is housed with a sensor 132 (FIG. 17) as described later.

Referring now to FIG. 10, notice that the circuit 48 comprises a capacitor bank 64 that is coupled in series to a switch 66, a first resistor $R_S$, first inductor $L_S$ and load inductor $L_L$, as shown. In the embodiment being described, the load inductor $L_L$ is the coil 46*a* (FIGS. 4, 5 and 7). The coil 46*a* has a coil length $C_{L1}$ (FIG. 4) that generally corresponds to the width W1 (FIG. 6) of the sheet 20 so that the portion 24*a* is expanded to engage the entire surface of inner wall 20*a* of sheet 20. This provides an interference fit over the entire joint between tube wall 24*c* (FIG. 6) and inner wall 20*a*. Likewise, the heat exchange tube expander 44 may comprise a second solenoid 70 having a second coil 70*a* (FIGS. 8 and 9) comprising a second coil length $C_{L2}$ that corresponds to the width $W_2$ (FIG. 9) of the baffle sheets 36*a*–36*d*. Thus, it should be understood that the lengths $C_{L1}$ and $C_{L2}$ of coils 46*a* and 70*a* are selected in response to the widths $W_1$ (FIG. 6) and $W_2$ (FIG. 9), respectively. Of course, widths $W_1$ and $W_2$ may vary depending on the sheets 20, 22 and 36*a*–36*d* used in the heat exchanger 10.

In the embodiment being described, the coils 46*a* and 70*a* each comprise 16 AWG square magnet wire. The coil 46*a*, for example, comprises at least 20 turns over a length $C_{L1}$ of about one inch, and the coil 70*a* comprises at least 20 turns over a length $C_{L2}$ of about one inch. Thus, the coils 46*a* and 70*a* are of similar construction, but in the embodiment being described they are operated at different power levels. It should be appreciated that the coils 46*a* and 70*a* may be of different construction if desired. The nominal inductance for the coils 46*a* and 70*a* is approximately 0.64 microhenries when inserted into one of the tubes 24. The nominal outside diameter of the coils 46*a* and 70*a* is slightly less than the diameter $D_5$ (FIG. 6) of the tube 24 so that the coils 46*a* and 70*a* can easily slide or pass through the passageway 24*e* of tube 24.

The capacitor discharge bank 64 of circuit 48 is capable of storing enough energy to perform the enlargement of the portion 24*a* (FIG. 6) and portion 24*b* (FIG. 9). It should be appreciated that the capacitor discharge bank 64 of circuit 48 is charged to an appropriate voltage level that will vary depending on, for example, the characteristics of the coil 46*a*, the portion 24*a* and portion 24*b* of the tube 24 to be enlarged, the characteristics of the sheets 20, 22 and 36*a*–36*d* and the like. During operation, the capacitor discharge bank 64 is charged by the power source 68 (FIG. 10). The switch 66 is then triggered to start current to flow through the coil 46*a* or coil 70*a*, depending on which coil that is being used. Through magnetic induction, the current flowing through the coil 46*a* induces an eddy current in the portion 24*a* that is directly opposed to the current flowing in coil 46*a*. This causes an electromagnetic expansion force that pushes or forces the portion 24*a* radially outwardly in the direction of arrows 71 and 72 (FIG. 5). This outward radial expansion of the portion 24*a* of tube 24 continues until the outer wall 24*d* (FIG. 6) of tube 24 impacts the inner wall 20*a* of sheet 20. It has been found that the radial expansion of the portion 24*a* of tube 24 impacts the inner wall 20*a* and causes the inner wall 24*a* to radially expand from its normal diameter $D_2$ to a slightly larger diameter. As the sheet 20 recovers from the impact from the wall 24*d*, the wall 20*a* will return or contract to substantially its original diameter $D_2$, thereby providing an interference pressure fit between the outer wall 24*d* of tube 24 and the inner wall 20*a* of sheet 20. This interference pressure can be of significant magnitude to allow scaling between the outer wall 24*d* of tube 24 and the inner wall 20*a* of sheet 20. This process and method is repeated at each intersection or joint between the tubes 24 and the inner walls of any surrounding members such as sheets 20 and 36. A method for assembling, manufacturing and repairing the heat exchanger 10 using the invention will now be described.

Figure 17A:
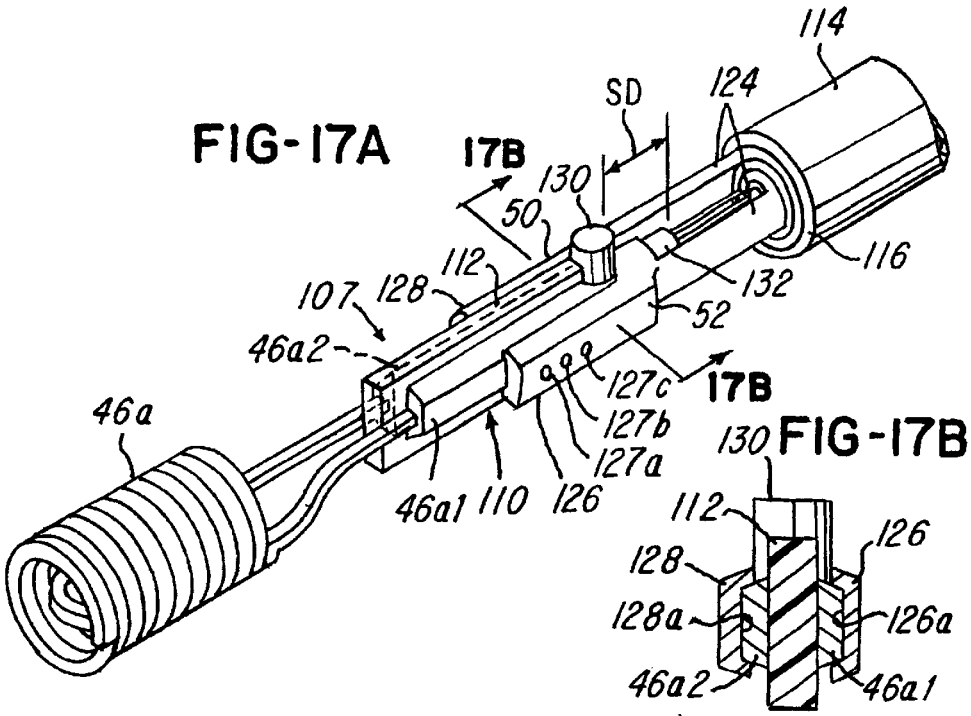
FIG. 17A is a fragmentary view of a detector and coil assembly.
Figure 18:
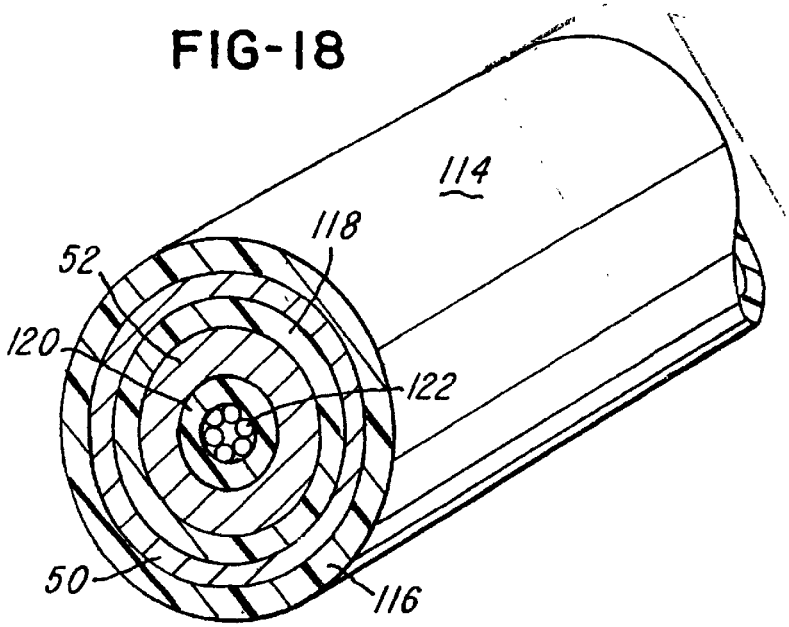
FIG. 18 is a view of a coaxial cable used in one embodiment.

Referring to FIG. 17A, a detector and coil assembly 107 is shown. The assembly 107 comprises the sensor 132 for sensing the sheet 20, 22 and 36*a*–36*d* and the coil 46*a*. The assembly 107 comprises the coil 46*a* which is received in an insulated termination housing 110. It is envisioned that the coil 46*a* can be detachably removed from the housing 110 so that it can be replaced, substituted, serviced, or the like. Advantageously, the invention comprises a coaxial cable 114 having the conductors 50 and 52 formed of wire braids. As illustrated in FIG. 18, the coaxial cable 114 comprises an insulator 116, the conductor 50, an insulator 118, the conductor 52, an insulator 120, and a sensor bundle 122, which will be described later herein.

Notice that the cable 114 terminates into a cable termination housing 124 which provides a first mount 126 and a second mount 128. The first and second mounts 126 and 128 have recessed areas 126*a* and 128*a* (FIG. 17B) for receiving and conductively coupling to a complementary first coil end 46*a*1 and a complementary second coil end 46*a*2, respectively, of coil 46*a*. Note that the coil terminal ends 46*a*1 and 46*a*2 are separated by an insulator 112 and conductively engage the first and second mounts 126 and 128, and they each may comprise a plurality of apertures, such apertures 127*a*–127*c* of first mount 126, which become aligned so that they can be conductively coupled together with any suitable fastener or fastening means, such as a screw or bolt, weld or the like. This allows for a quick connection and disconnection of the coil ends 46*a*1 and 46*a*2 from the coaxial cable mounts 126 and 128, respectively.

A permanent magnet 130 is attached to the cable termination lug or mount 126 as shown. In the embodiment being described, the permanent magnet 130 generates a magnetic flux which is interrupted by a sheet 20, 22 or 36*a*–36*d* as the assembly 107 is moved through the tube 24. The coaxial cable 114 comprises the sensor 132 (FIGS. 10 and 17) that is coupled to the sensor bundle 122 (FIG. 18) contained in the center of the coaxial cable 114. The sensor 132 is a Hall effect sensor, but could comprise any suitable sensor capable of sensing the sheets 20, 22 and 36*a*–36*d*. The sensor 132 is positioned on the cable 114 so that when the connection to the coil 46*a* is made, the sensor 132 is positioned at an appropriate working distance from the permanent magnet 130.

The Hall effect sensor 132 cooperates with the permanent magnet 130 to sense a position of one of the sheets 20, 22 or 36*a*–36*d* as the assembly 107 is moved through the tube 24. In this regard, note that the sensor 132 is situated a predetermined distance SD from the magnet 130. When sensor 132 senses a sheet 20, 22 or 36*a*–36*d*, the sensor bundle 122 carries the signal to a controller 49 (FIG. 10) for controlling operation of the assembly 107 and power supply 68. In response, the controller 49 will energize a display 51 or alarm (not shown) to indicate that the coil 46*a* is operatively positioned to enlarge at least a portion of the tube 24 as described herein. The display 51 may be an LCD or other type of suitable display. The enlargement of at least a portion of tube 24 may then proceed to the next sheet 20, 22 and 36*a*–36*d*.

It should be understood that the first mount 126 is coupled to a negative side of the power supply 68 (FIG. 10), and the second mount 128 is coupled to a positive side of power supply 68. The pulse power will be fed to the coil 46*a* via the braided conductors 50 and 52. The cable 114 is designed to have voltage hold-off capability of at least 10 kV. Both braided conductors 50 and 52 are sized to have a cross-sectional area to safely carry a pulse current to a peak value of at least 35 kA at a rate of one pulse per five seconds or faster.

When required, a solder or sealing material (not shown) may be applied to the tube surface before forming the joint. Upon expansion of the tube 24, the solder or sealant melts or softens and the tube 24 presses the solder or sealant into the joint so as to fill any open spaces.

Advantageously, this system and method provides an assembly 107 for detecting or sensing a location of a sheet 20, 22 or 36*a*–36*d* and for enlarging at least a portion of tube 24. Note that the assembly 107 and cable 114 can be easily and quickly moved and positioned in and through tube 24. Also, the sensor bundle 122 (FIG. 18) and the braided conductors 50 and 52 are formed into a bundle which is centrally located within the insulator 116. This facilitates reducing the diameter of assembly 107. The method or process of the invention will now be described.

Figure 16:
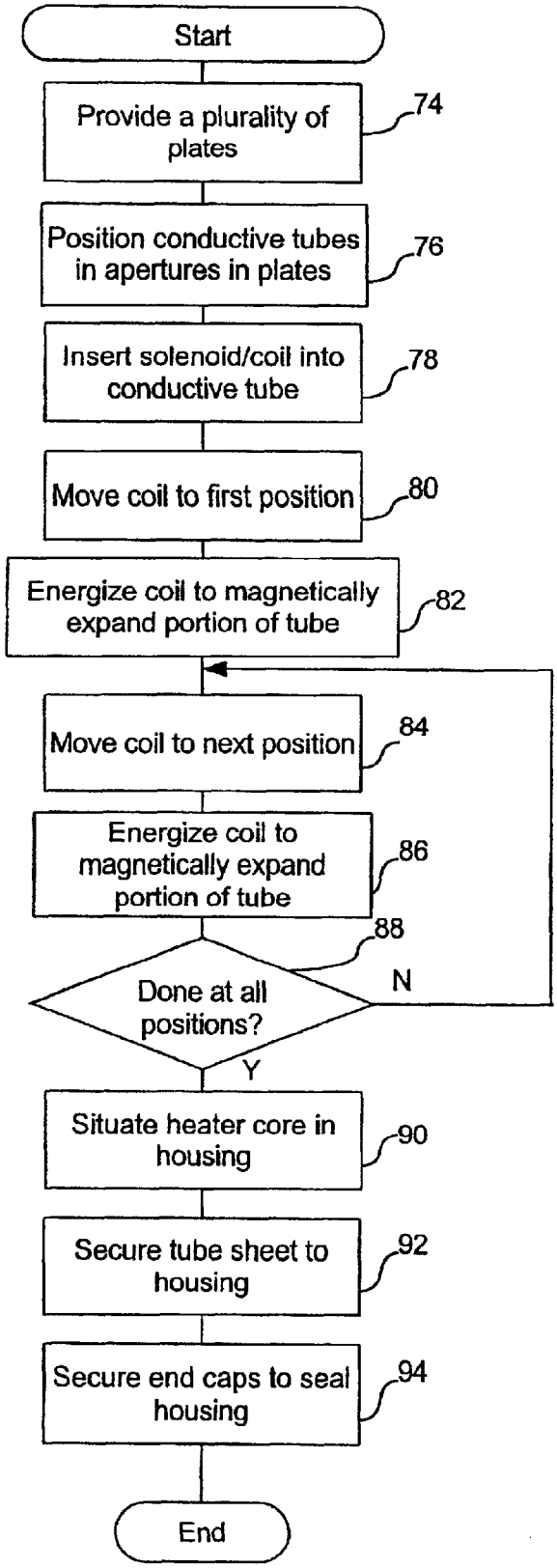
FIG. 16 is a schematic view illustrating a method in accordance with one embodiment of the invention.

The method begins (block 74 in FIG. 16) by providing a plurality of sheets, such as sheets 20, 22 and 36*a*–36*d* that are secured to the housing 12. At block 76, the plurality of conductive tubes 24 are situated in the apertures 23 and 38 (FIG. 8) and between the sheets 20 and 22, as illustrated in FIGS. 1–3. The coil 46*a* is then aligned with the tube passageway 24*e* (FIG. 4) and inserted (block 78 in FIG. 16) into the passageway 24*e* of the tube 24. The coil 46*a* is then moved to a first position 96 (FIG. 7) until it is aligned with the sheet 20, as illustrated in FIG. 5. At this position, the coil 46*a* becomes generally aligned with the inner wall 20*a* of the sheet 20 in the illustration. As illustrated in FIG. 7, a plurality of other positions 98, 100, 102 and 104 correspond to a plurality of other positions or imaginary planes in which the baffle sheets 36*a*–36*d* may be situated. Similarly, the sheet 22 lies in an imaginary plane 106 and corresponds to another position at which solenoid 46*a* may be moved. For ease of description, only the fastening of portion 24*a* (FIG. 6) to tube sheet 20 is described, but it should be appreciated that the same technique is used to secure each tube 24 to any surrounding member, such as inner walls 20*a* and 36*a*.

Returning to the illustration, after the coil 46*a* is moved (block 80 in FIG. 16) to the first position 96 (FIG. 7) and generally aligned with the wall 20*a* of sheet 20, a user actuates switch 66 or if in automatic mode the device detects a sheet (FIGS. 2, 7 and 10) energizes the coil 46*a*. As a pulse of current flows through the coil 46, an opposite flowing eddy current is induced in the tube 24. This results in magnetic pressure acting on the tube 24 to expand the portion 24*a* of the tube 24 that is opposed to the coil 46*a* to expand or be forced radially outwardly in the direction of arrows 71 and 72 until the outer wall 24*d* (FIG. 6) of tube 24 engages the inner wall 20*a* of sheet 20, thereby securing the portion 24*a* of tube 24 to the inner wall 20*a* of sheet 20. It may be desirable to repeatably pulse the current through the coil 46*a*, particularly if a large distance between the wall 24*c* and inner wall 20*a* exists. In the embodiment described, the current is pulsed for approximately 20 micro seconds.

The coil 46*a* is then moved (block 84 in FIG. 16) to the next position, such as position 106 for coil 46*a*, where the coil 46*a* is again energized (block 86 in FIG. 16) to secure the tube 24 to the tube sheet 22. As mentioned earlier herein, if a width $W_1$ (FIG. 4) of sheet 20 is different than the width W2 (FIG. 8) of sheet 36, then it may be desirable to use a different coil, such as the coil 70*a* at the positions 98–104 (FIG. 7). Preferably a coil having the length $C_{L2}$ corresponding to the width $W_2$ (FIG. 9) of the baffle sheet 36*a* should be used. This coil 70*a* would be used for each of the positions 98, 100, 102 and 104 to secure each of the plurality of tubes 24 to the inner walls, such as inner wall 36*e* of baffle sheet 36*a*, of any surrounding baffle sheets 36*a*–36*d*. At decision block 88, it is determined whether the process is complete at all positions. If it is, the process proceeds as shown, but if not, the process loops back to block 84. As mentioned earlier, the process can be conducted from only one of the ends 12*c* or 12*d*, or from both ends 12*c* and 12*d*.

In the example, the solenoid or coil 46*a* traverse the entire length L of tube 24 creating tube sheet joint at each position where the sheets 20 and 22 surround the tube 24. The system then automatically traverses the solenoid or coil 46*a* in an opposite direction and the tube 24 is expanded at each position where a baffle plate 36*a*–36*d* surrounds it. Automatic positioning may be accomplished using the sensor (FIG. 7) mentioned earlier. The traverse speed through the tube may be on the order of about 60 feet/minute, but this speed could be higher or lower if desired.

It is contemplated that the system and method of the invention can be used to manufacture or assemble the tube bundle 18 comprising the sheets 20, 22 and 36*a*–36*d* secured to the plurality of tubes 24 outside of housing 12, as alluded to earlier herein. The assembled tube bundle 18 is then mounted in the surrounding housing 12. Alternatively, the housing 12 may be provided with one or more of the sheets 20, 22 or 36*a*–36*d* mounted therein. The plurality of conductive tubes 24 are then inserted in the sheets 20, 22 and 36*a*–36*d*. In this case, the system and method is used to secure the plurality of conductive tubes 24 to the sheets 20, 22 and 36*a*–36*d* after the plurality of conductive tubes 24 are situated in apertures 23 and 38, as mentioned in the illustration.

Figure 15:
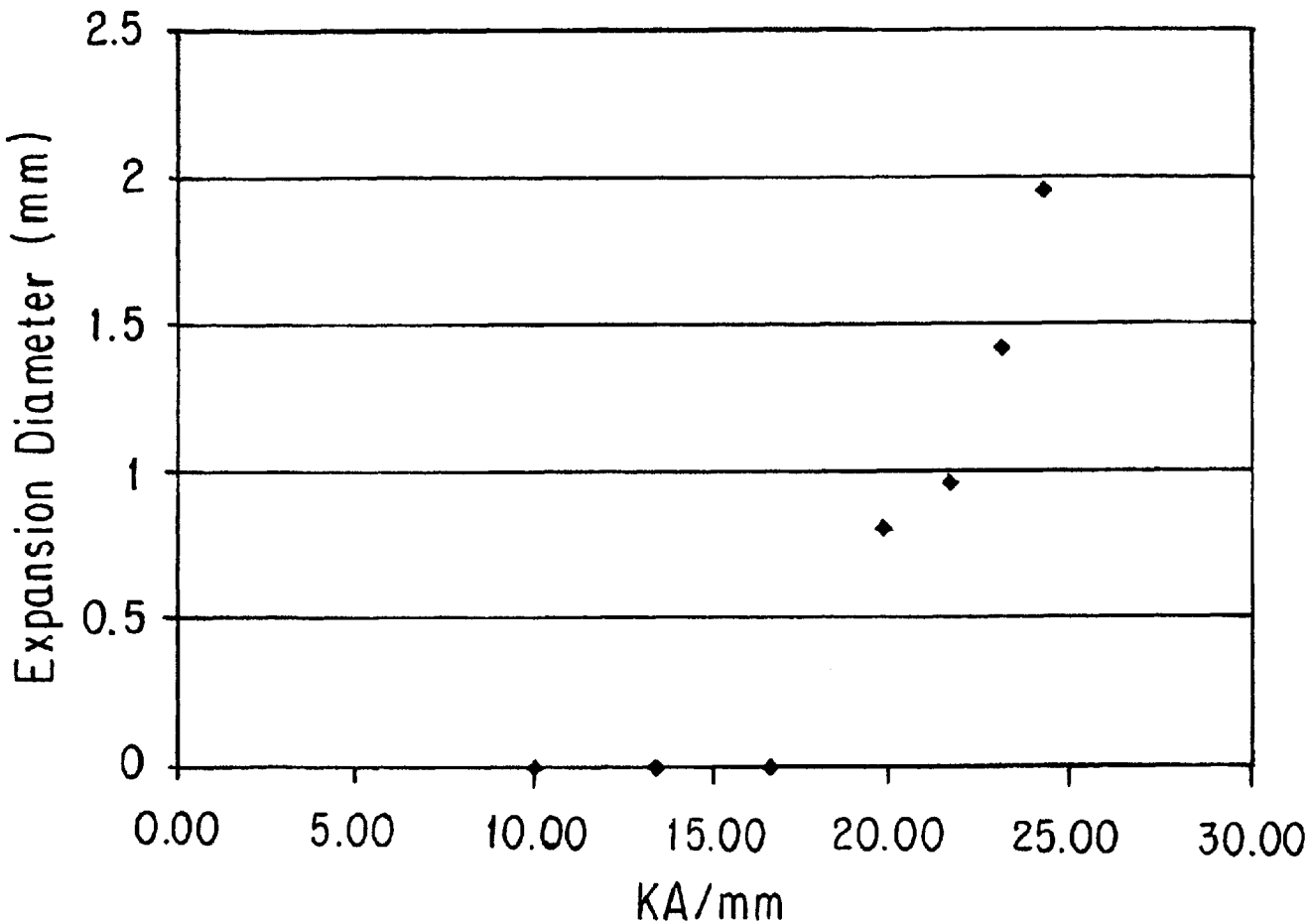
FIG. 15 is chart illustrating various expansion results for an enhanced tube.

If the tube bundle 18 is assembled outside of the housing 12, then the routine proceeds to block 90 in FIG. 15 where the tube bundle 18 is situated in the housing 12 and the sheets 20 and 22 are secured to the housing 12 (block 92). The first header or end bell 14 and a second header or end bell 16 are then secured to the housing 12 by bolting the flanges 14*a* and 16*a* to the flanges 12*a* and 12*b*, respectively, as shown in FIG. 1.

It should be appreciated that the heat exchange tube expander 44 may further comprise a sensor 108 (FIG. 7) for sensing the positions 96–106 to facilitate a quick alignment of the coils 46*a* and 70*a* in the various imaginary planes in which the sheets 20, 22 and 36*a*–36*d* lie. One example of such a sensor is the Hall effect sensor 122 (FIG. 17) or eddy current probe, such as is shown by U.S. Pat. No. 4,889,679 which is incorporated herein and made a part hereof.

In one embodiment, the tube 24 is expanded into the apertures 23 in the sheets 20 as the coil 46*a* is in motion in the tube 24. Upon energizing the coil 46*a*, the tube 24 expands almost instantaneously. Accordingly, it is not necessary to bring the coil 46*a* to a complete stop each time a joint is formed. The coil 46*a* can be automatically activated each time the coil 46*a* aligns with the sheet 20 by coupling the coil 46*a* with the sensor mentioned herein or by closing the switch 66 in the coil circuit 48 each time the coil 46*a* travels to a pre-measured point in the tube 24. In either case, in this embodiment, as the coil 46*a* travels continuously through the tube 24, the tube 24 is automatically energized and the tube 24 is expanded "on the fly," without stopping. Of course, those skilled in the art will appreciate that if necessary, the coil 46*a* could be slowed as it aligns with each sheet 20 or the coil 46*a* could momentarily stop. However, for many tube designs and constructions, it will be possible to form joints "on the fly" while the coil 46*a* is moving.

Although the embodiment described and shown herein shows a plurality of coils 46*a* and 70*a*, it should be appreciated that more or fewer coils may be used if desired. Also, the coils 46*a* and 70*a* may be comprised of different gauge wire, different lengths, different number of turns and the like.

It should further be appreciated that the system and method of the present invention may be used to assemble and manufacture a heat exchanger 10 and may be used to repair any intersection or joint between the tube 24 and one of the sheets 20, 22 and 36*a*–36*d*. During repair, one or both of the end bells 14 and 16 must be removed to gain access to the tubes 24.

A further feature of Applicants' invention is that the heat exchange tube expander 44 comprises a plurality of wheels 58 secured to housing 56 so that it can be moved, for example, from the first end 12*c* (FIG. 2) to the second end 12*d* (FIG. 3). This is particularly convenient when assembling, manufacturing or repairing heat exchangers having a length L (FIG. 1) over 96 inches. The heat exchange tube expander 44 may be used from either one of the ends 12*c* or 12*d* or both ends 12*c* or 12*d* as mentioned previously, whereupon the coil 46*a* would be moved through the entire tube 24, which time is saved in not moving the expander to the opposite end of the heat exchanger. Alternatively, the heat exchange tube expander 44 may be used at one of end 12*c* to, for example, expand portions over the approximately one-half a length (i.e.—to the middle of the tube 24) of tube 24, withdraw the coil 46*a*, whereupon the coil 46*a* may be inserted into the tube from the opposite end 12*d* and then energized to expand portions of the second half of tube 12.

EXAMPLE

One example of Applicants' invention will now be described. Applicants used a tube 24 having a nominal outside diameter of 0.74 inches and a nominal inside diameter of 0.59 inches. The coil 46*a* was made from 16 AWG square magnet wire and consisted of 22 turns over a length of about 1.25 inches. The nominal inductance for the coil 46*a* was approximately 0.5 microhenries when inserted into the tube 24. The outside diameter of the coil 46*a* was about 0.565 inch. The coil 46*a* was connected to the circuit 48 that had a capacitor discharge bank 64 having a total capacitance of about 50 microfarads. The capacitors (not shown) comprising the capacitor discharge bank 64 were charged to a voltage of about 7.5 kV resulting in a total current of about 35 kA through the coil 46*a*. The total stored energy based on these values was approximated at 1406 Joules.

The coil 46*a* was inserted into the tube 24 and positioned in operative relationship with the wall 20*a* of sheet 20, with the tube 24 situated therebetween. It should be appreciated that the inner wall 20*a* had a diameter of about 0.76 inch, and the sheet 20 had a thickness or width $W_1$ (FIG. 6) of approximately 1.25 inches. The switch 66 was triggered which induced a current to flow through coil 46*a*. This, in turn, caused the portion 24*a* to impact inner wall 20*a* as it expanded. As the wall 20*a* recovered to substantially its original dimension ($D_2$ in FIG. 6), it caused an interference pressure between the surface 24*d* (FIG. 5) and the inner wall 20*a*. The interface pressure was significant enough to secure the tube 24 to the sheet 20. Preferably, transport apparatuses analogous to the devices used to transport mechanical tube expanders used in the past may be employed for transporting the detector assembly 107 (FIG. 17) and coil 46*a*.

In the example being described, the total stored energy was 1400 Joules, total capacitance was 50 microfarads and the total load inductance $L_L$ in the tube 24 was about 0.5 microhenries. The total system inductance $L_S$ was about 1.4 microhenries and total system resistance $R_S$ was 10–20 milliohms with a peak current of about 35 kA in tube 24. The coil 46*a* was driven with a ringing pulse lasting approximately 200 microseconds. The rise time of the first current peak is 10–20 microseconds. Most of the forming or expansion of the tube 24 occurs during the first peak.

FIG. 15 illustrates further expansion result data for an enhanced heat transfer tube 24. The x-axis of the chart in FIG. 15 represents a peak magnetic pressure applied and the y-axis correlates to the expansion results. Note that as the current increased, the bulge diameter of the tubes 24 increased. For example, significant expansion was not observed until a current of at least 15 kA/mm after this level, the diametrical expansion increased approximately linearly to a value of nearly 2 mm at a current of 25 kA/mm.

Although the embodiment has been shown and described relative to an illustrative embodiment, a particular example and some particular data to illustrate various features of the invention, it should be appreciated that the various values achieved may change depending on the coil 46*a* or 70*a* used; thickness of tube 24; the inner and outer diameters of the tube 24; the dimensions $D_1$–$D_4$, $W_1$, $W_2$, $C_{L1}$ and $C_{L2}$; the material comprising the tube 24 and the sheets 20, 22, 36*a*–36*d* and the like. In the embodiment being described, the components of the circuit 48 may also change. What is important, however, is that the coil used be configured to be capable, through magnetic induction, to expand at least that portion 24*a* (FIG. 6) and portion 24*b* (FIG. 9) of tube 24 to engage and secure the tube 24 to the sheet 20, 22 or 36*a*–36*d* that surrounds the tube 24.

In the embodiment being described, the tubes 24 are copper and comprise a length of about 240 inches and have an outer diameter of about ¾ inch. The tubes 24 may comprise internal spiral ridges and external formed fins (not shown) to further facilitate heat exchange. The distance between the sheets 20 and 22 and varies depending on the heat exchanger manufacturers requirements and TEMA Standards. The heat exchanger 10 comprises four baffle sheets 36*a*–36*d* in the embodiment shown, but it could comprise more, fewer, or even no baffle sheets 36*a*–36*d* as required by TEMA Standards for heat exchanger construction. Moreover, a distance between the position of the sheets 20, 22 and 36*a*–36*d*, such as a distance between position 96 and 98 or a distance between position 100 and 102 in FIG. 7, is approximately 19 inches in the embodiment being described. Of course, this distance could be varied depending on, for example, the number or sheets 36*a*–36*d* or the interference of the fluid flow pattern desired as specified by the heat exchanger manufacturer.

Heat exchangers are manufactured in a variety of lengths, diameters, quantity of tubes and heat transfer medias. These configurations are established by the heat exchanger manufacturer and are derived from end user requirements.

Figure 19:
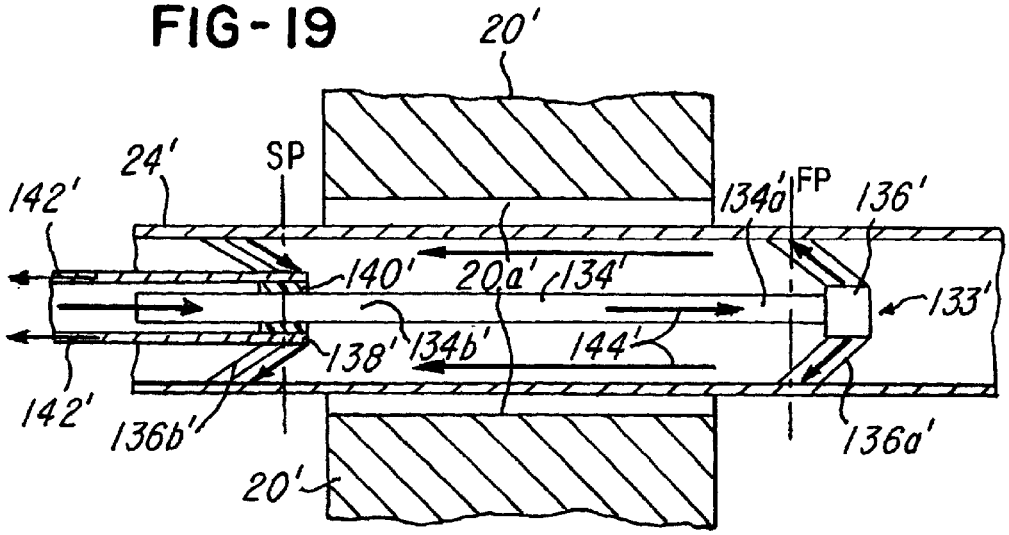
FIG. 19 is a view of a direct drive expander before energization.
Figure 20:
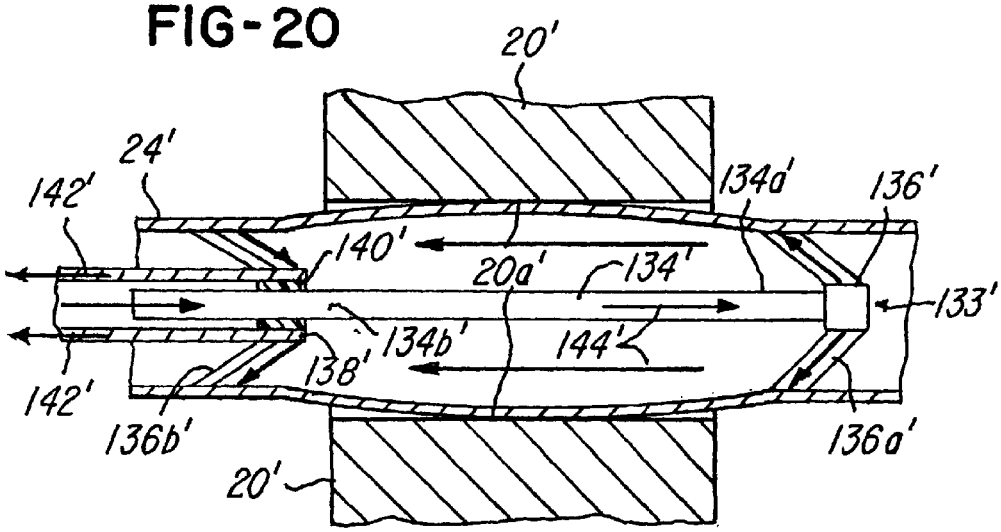
FIG. 20 is a view of a direct drive expander after energization.

Other means for magnetically expanding tube 24 can also be used. One such means is referred to herein as a direct drive expander in which FIGS. 19 and 20 illustrate another embodiment of the invention. It should be understood that like parts and parts in this embodiment are identified with the same part numbers, except that an apostrophe ("') has been added to part numbers in FIGS. 19 and 20. It should be understood that in this embodiment, a direct drive expander 133' is provided for enlarging at least the portion 24*a'* (FIG. 6) of tube 24'. The direct drive expander 133' comprises a core conductor 134'. The conductor 134' is coupled to a first compliant contact 136' at a first end 134*a'*. A second compliant contact 138' is situated on a second end 134*b'* of conductor 134'. Notice in FIG. 19 that an insulator 140' is situated between the second compliant contact 138' and the conductor 134' as shown. The conductor 134' is coupled to a positive side of the power supply 68' (FIG. 10), and the conductor 138' is coupled to the negative side of the power supply 68'.

Each of the first and second compliant contacts 136' and 138' comprise a brush 136*a'* and 136*b'* for providing a continuous contact with the portion of the inner wall of tube 24' that lies in a first plane FP and second plane SP, respectively, as illustrated in FIG. 19.

During use, the direct drive expander 133' is situated in operative relationship with the sheet 20' as illustrated in FIG. 19. For this purpose, a sensor, such as sensor 132' (FIG. 10), may be employed with the direct drive expander 133' to align it with a sheet 20', 22' or 36*a'*–36*d'*. After the direct drive expander 133' is situated in operative relationship with the sheet 20', the switch 66' (FIG. 10) may be closed to cause electric current to flow through the conductor 134' in the direction of arrow 144' as illustrated. The current flows from the first contact 136' through the tube 24', through the second contact 138' and then back to the power supply 68'. When the electrical current flows in the manner illustrated by the arrows 144', electromagnetic pressure is created upon the wall of tube 24'. When the magnetic pressure is applied, the tube 24' expands in a radial direction, as illustrated in FIG. 20. As the diameter of the tube 24' increases, it ultimately engages the inner wall 20*a'* to secure the tube 24' to the sheet 20' as shown.

It should be appreciated that the first and second contacts 136' and 138' may be comprised of compliant brushes which may be flexible to permit the direct drive enlarger 133' prime to be driven through the tube 24' either manually or with a feeding mechanism (not shown). The direct drive expander 133' may also be used with the cable 114' described earlier.

Advantageously, these systems and methods provide means for manufacturing, assembling and even repairing a tubular heat transfer system 10. The system and method further provides means for expanding a dimension of a tube

24 in a tube bundle 18 or used in a tubular heat transfer system 10 to facilitate securing the tube 24 to one or more of the sheets 20, 22 and 36*a*–36*d* situated in the tubular heat transfer system 10 by magnetically expanding at least a portion of the tube 24. This technique is believed to be superior to techniques, such as mechanical expansion techniques, of the past. The system and method improve the means by which tubes 24 are secured to one or more of the sheets 20, 22 and 36*a*–36*d* in a tubular heat transfer system 10 and improve the joints between the tubes 24 and any surrounding walls, such as wall 20*a* of sheet 20.

While the systems and methods herein described, and the forms of apparatus for carrying these systems and methods into effect, constitute one embodiment of this invention, it is to be understood that the invention is not limited to these precise methods and forms of apparatus, and that changes may be made in either without departing from the scope of the invention, which is defined in the appended claims.

What is claimed is:

1. A method for securing a conductive tube to a surrounding member of a tubular heat transfer system, said method comprising the steps of:

inserting a coil into a conductive tube;

moving said coil along the inside of said tube;

when said coil reaches a position at which said tube intersects said surrounding member, while the coil is moving, energizing said coil to expand the portion of the conductive tube at the position of intersection and thereby securing said conductive tube to said surrounding member.

2. The method of claim 1 wherein the method includes the additional steps of sensing the position at which said tube intersects said surrounding member and energizing said coil in response to sensing said intersection.

3. The method of claim 1 wherein the method includes the additional steps of determining the position at which said tube intersects said surrounding member and energizing said coil in response to determining said intersection.

4. The method of claim 1 wherein the method includes the additional steps of:

moving the coil to a second position at which said tube intersects a second surrounding member, and when said coil reaches said second position, while said coil is moving, energizing said coil to expand the portion of the conductive tube at the position of intersection and thereby securing said conductive tube to said second surrounding member.

5. The method of claim 4 wherein the method includes the additional steps of sensing the position at which said tube intersects said surrounding members and energizing said coil in response to sensing said intersection.

6. The method of claim 4 wherein the method includes the additional steps of determining the position at which said tube intersects said surrounding members and energizing said coil in response to determining said intersection.

* * * * *